US011612236B2

(12) United States Patent
Krishan et al.

(10) Patent No.: US 11,612,236 B2
(45) Date of Patent: Mar. 28, 2023

(54) SMART HAIR GROOMING DEVICE

(71) Applicant: The Procter & Gamble Company, Cincinnati, OH (US)

(72) Inventors: Kapilanjan Krishan, Singapore (SG); Sujatha Logou, Singapore (SG); Jishna Bole, Singapore (SG); Jing Yu Kek, Singapore (SG); Qingqing Miao, Singapore (SG); Mitoshi Nandi, Singapore (SG); Teck Wu Ong, Singapore (SG)

(73) Assignee: The Procter & Gamble Company, Cincinnati, OH (US)

( * ) Notice: Subject to any disclaimer, the term of this patent is extended or adjusted under 35 U.S.C. 154(b) by 331 days.

(21) Appl. No.: 16/877,538

(22) Filed: May 19, 2020

(65) Prior Publication Data

US 2021/0361059 A1 Nov. 25, 2021

(51) Int. Cl.

| | |
|---|---|
| ***A46B 15/00*** | (2006.01) |
| ***A46B 9/02*** | (2006.01) |
| ***A45D 24/00*** | (2006.01) |
| *A46B 17/00* | (2006.01) |

(52) U.S. Cl.

CPC ..... *A46B 15/0006* (2013.01); *A45D 24/00* (2013.01); *A46B 9/023* (2013.01); *A46B 17/00* (2013.01); *A46B 2200/104* (2013.01)

(58) Field of Classification Search

CPC ..... G06F 3/0346; A46B 15/0004; A46B 15/0012; A46B 15/0002; A46B 15/0006; A46B 9/023; A46B 2200/104; A45D 24/00

See application file for complete search history.

(56) References Cited

U.S. PATENT DOCUMENTS

| | | | | |
|---|---|---|---|---|
| 10,470,545 | B2 * | 11/2019 | Thiebaut | A46B 15/0006 |
| 2003/0226397 | A1 | 12/2003 | Sherman | |
| 2015/0342515 | A1 | 12/2015 | Hutchings | |
| 2016/0278690 | A1 | 9/2016 | Hyde | |
| 2017/0020276 | A1 | 1/2017 | Brewer | |
| 2018/0184796 | A1 | 7/2018 | Balooch | |
| 2019/0098977 | A1 | 4/2019 | Thiebaut | |
| 2019/0209078 | A1 | 7/2019 | Charraud et al. | |

FOREIGN PATENT DOCUMENTS

| | | | |
|---|---|---|---|
| CN | 203563823 | U | 4/2014 |
| CN | 105495973 | A | 4/2016 |
| CN | 205923310 | U | 2/2017 |

(Continued)

OTHER PUBLICATIONS

"What is a Light Dependent Resistor and Its Applications" Jul. 18, 2019, https://www.watelectronics.com/light-dependent-resistor-ldr-with-applications/. (Year: 2019).*

(Continued)

*Primary Examiner* — Laura C Guidotti

(74) *Attorney, Agent, or Firm* — John G. Powell

(57) ABSTRACT

Hair grooming device, system and method for measuring interaction with hair of a person during a hair grooming event, including a processor readable storage medium, storing executable instructions and a processor in communication with the processor readable storage medium.

19 Claims, 6 Drawing Sheets

(56) References Cited

FOREIGN PATENT DOCUMENTS

| | | | |
|---|---|---|---|
| CN | 106596394 | A | 4/2017 |
| CN | 107048665 | A | 8/2017 |
| CN | 108669763 | A | 10/2018 |
| DE | 102017209225 | A1 | 12/2018 |
| EP | 3586673 | A1 | 1/2020 |
| FR | 2442607 | A1 | 6/1980 |
| IN | 201711023062 | | 12/2017 |
| JP | 2016073526 | A | 5/2016 |
| WO | WO2019018151 | A1 | 1/2019 |
| WO | WO2019034635 | A1 | 2/2019 |

OTHER PUBLICATIONS

PCT Search Report and Written Opinion for PCT/US2021 /070538 dated Aug. 5, 2021, 15 pages.

* cited by examiner

SMART HAIR GROOMING DEVICE

FIELD OF THE INVENTION

The disclosure generally relates to a brush or comb device and, more particularly, to a device that measures data related to interaction of the device with hair of a person.

BACKGROUND OF THE INVENTION

Traditionally, hair brushes and combs have been used to interact with or groom a person's hair. This interaction can be related to a condition of the hair.

SUMMARY OF THE INVENTION

An embodiment relates to a method for measuring interaction of a hair grooming device with hair of a person during a hair grooming event that includes collecting data from at least one sensor integrated with the hair grooming device during the hair grooming event, wherein the at least one sensor measures interaction of the hair grooming device with the hair; concurrent with collecting the data, determining, using a proximity sensor integrated with the hair grooming device, at least one value indicative of a proximity of the hair grooming device to the hair of the person; based on the at least one value indicative of the proximity of the hair grooming device to the hair, filtering the data collected from the at least one sensor; and storing the filtered data. In particular, the hair grooming device can be a brush or a comb. The proximity sensor can include a light dependent resistor. As such, the at least one value indicative of the proximity of the hair grooming device to the hair of the person indicates whether or not the hair grooming device is proximate to the hair of the person.

In accordance with this embodiment the hair grooming device may include a structural feature configured to contact the hair of the person when in use and the at least one value indicative of the proximity of the hair grooming device to the hair of the person is indicative of the proximity of the structural feature to the hair of the person.

Furthermore, filtering the data can include determining a weighting amount based on the at least one value indicative of the proximity of the hair grooming device to the hair; and adjusting the collected data based on the weighting amount. Also, collecting data from the at least one sensor can include collecting a respective first data value for each of a series of discrete time periods; wherein determining the at least one value indicative of a proximity of the hair grooming device to the hair of the person may comprise determining a respective second data value corresponding to each of the discrete time periods; and wherein filtering the data collected from the at least one sensor may comprise: a) determining a respective weighting value for each of the discrete time periods based on the respective second data value corresponding to each discrete time period; and b) calculating a respective adjusted data value for each discrete time period based on the respective first data value and the respective weighting value corresponding to each discrete time period, wherein the filtered data may comprise the respective adjusted values.

The sensor, other than the light dependent resistor, can include at least one sensor comprising one or more of a pressure sensor, a load cell, an accelerometer, or a gyroscope.

In one embodiment, storing the filtered data comprises storing the filtered data in memory circuitry integrated with the hair grooming device. In a different embodiment, storing the filtered data may comprise transmitting the filtered data to an apparatus external to the hair grooming device, the apparatus comprising memory circuitry configured to store the filtered data. In yet a different embodiment, the method may include transmitting the collected data to an apparatus external to the hair grooming device; transmitting, to the apparatus, the at least one value indicative of the proximity of the hair grooming device to the hair of the person; and wherein the filtering of the data collected from the at least one sensor may comprise filtering, by the apparatus, the transmitted collected data based on the transmitted at least one value indicative of the proximity of the hair grooming device to the hair of the person.

In accordance with an embodiment, filtering the collected data may comprise discarding the collected data when the at least one value indicative of the proximity of the hair grooming device to the hair of the person indicates that the hair grooming device is not proximate to the hair of the person.

Another embodiment relates to a method for measuring interaction of a hair grooming device with hair of a person during a hair grooming event, that includes collecting first data from at least one sensor integrated with the device during a first hair grooming event, wherein the at least one sensor measures interaction of the hair grooming device with the hair; concurrent with collecting the first data, determining, using a proximity sensor integrated with the device, at least one first value indicative of a proximity of the device to the hair of the person; based on the at least one first value indicative of the proximity, filtering the first data collected from the at least one sensor; storing the filtered first data; collecting second data from the at least one sensor integrated with the device during a second hair grooming event; concurrent with collecting the second data, determining, using the proximity sensor integrated with the device, at least one second value indicative of the proximity of the device to the hair of the person; based on the at least one second value indicative of the proximity, filtering the second data collected from the at least one sensor; and comparing the filtered first data to the filtered second data.

Yet another embodiment relates to a system for measuring interaction of a hair grooming device with hair of a person during a hair grooming event. The system can include a hair grooming device; a processor readable storage medium, storing executable instructions; and a processor in communication with the processor readable storage medium. In particular, the processor when executing the executable instructions: collects data from at least one sensor integrated with the hair grooming device during the hair grooming event, wherein the at least one sensor measures interaction of the hair grooming device with the hair; concurrent with collecting the data, determines, using a proximity sensor integrated with the hair grooming device, at least one value indicative of a proximity of the hair grooming device to the hair of the person; based on the at least one value indicative of the proximity of the hair grooming device to the hair, filters the data collected from the at least one sensor; and stores the filtered data. In particular, the hair grooming device can be a brush or a comb. The proximity sensor can include a light dependent resistor. As such, the at least one value indicative of the proximity of the hair grooming device to the hair of the person indicates whether or not the hair grooming device is proximate to the hair of the person.

In accordance with this embodiment the hair grooming device includes a structural feature configured to contact the hair of the person when in use and the at least one value indicative of the proximity of the hair grooming device to the hair of the person is indicative of the proximity of the structural feature to the hair of the person.

Furthermore, filtering the data can include determining a weighting amount based on the at least one value indicative of the proximity of the hair grooming device to the hair; and adjusting the collected data based on the weighting amount. Also, collecting data from the at least one sensor can include collecting a respective first data value for each of a series of discrete time periods; wherein determining the at least one value indicative of a proximity of the hair grooming device to the hair of the person comprises determining a respective second data value corresponding to each of the discrete time periods; and wherein filtering the data collected from the at least one sensor comprises: a) determining a respective weighting value for each of the discrete time periods based on the respective second data value corresponding to each discrete time period; and b) calculating a respective adjusted data value for each discrete time period based on the respective first data value and the respective weighting value corresponding to each discrete time period, wherein the filtered data comprises the respective adjusted values.

The sensor, other than the light dependent resistor can include at least one sensor comprising one or more of a pressure sensor, a load cell, an accelerometer, or a gyroscope.

In one embodiment, storing the filtered data comprises storing the filtered data in memory circuitry integrated with the hair grooming device. In a different embodiment, storing the filtered data comprises transmitting the filtered data to an apparatus external to the hair grooming device, the apparatus comprising memory circuitry configured to store the filtered data. In yet a different embodiment, the processor when executing the instructions transmits the collected data to an apparatus external to the hair grooming device; transmits, to the apparatus, the at least one value indicative of the proximity of the hair grooming device to the hair of the person; and the filtering of the data collected from the at least one sensor comprises filtering, by the apparatus, the transmitted collected data based on the transmitted at least one value indicative of the proximity of the hair grooming device to the hair of the person.

In accordance with an embodiment, filtering the collected data comprises discarding the collected data when the at least one value indicative of the proximity of the hair grooming device to the hair of the person indicates that the hair grooming device is not proximate to the hair of the person.

Another embodiment relates to a system for measuring interaction of a hair grooming device with hair of a person during a hair grooming event. The system can include a hair grooming device; a processor readable storage medium, storing executable instructions; and a processor in communication with the processor readable storage medium. In particular, the processor when executing the executable instructions: collects first data from at least one sensor integrated with the device during a first hair grooming event, wherein the at least one sensor measures interaction of the hair grooming device with the hair; concurrent with collecting the first data, determines, using a proximity sensor integrated with the device, at least one first value indicative of a proximity of the device to the hair of the person; based on the at least one first value indicative of the proximity, filters the first data collected from the at least one sensor; stores the filtered first data; collects second data from the at least one sensor integrated with the device during a second hair grooming event; concurrent with collecting the second data, determines, using the proximity sensor integrated with the device, at least one second value indicative of the proximity of the device to the hair of the person; based on the at least one second value indicative of the proximity, filters the second data collected from the at least one sensor; and compares the filtered first data to the filtered second data.

Yet another embodiment relates to a hair grooming device for measuring interaction with hair of a person during a hair grooming event in which the hair grooming device can include a brush; a processor readable storage medium, storing executable instructions; and a processor in communication with the processor readable storage medium. In particular, the processor when executing the executable instructions: collects data from at least one sensor integrated with the hair grooming device during the hair grooming event, wherein the at least one sensor measures an interaction of the hair grooming device with the hair, and concurrent with collecting the data, determines, using a proximity sensor integrated with the hair grooming device, at least one value indicative of a proximity of the hair grooming device to the hair of the person; filters the data collected from the at least one sensor, based on the at least one value indicative of the proximity of the hair grooming device to the hair; and stores the filtered data.

In accordance with this embodiment, the hair grooming device can include a structural feature configured to contact the hair of the person when in use, wherein the at least one value indicative of the proximity of the hair grooming device to the hair of the person is indicative of the proximity of the structural feature to the hair of the person.

Furthermore, the processor when executing the executable instructions can determine a weighting amount based on the at least one value indicative of the proximity of the hair grooming device to the hair; and adjust the collected data based on the weighting amount.

DETAILED DESCRIPTION OF THE INVENTION

Figure 1:
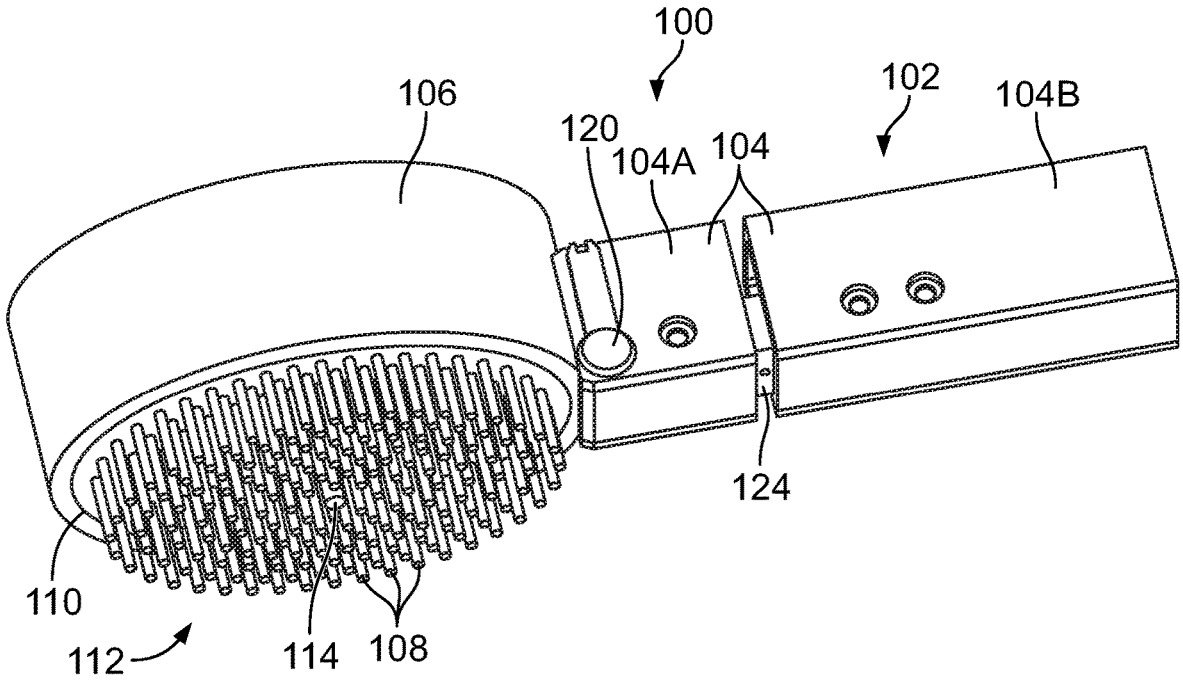
FIG. 1 is a perspective view of a hair grooming device configured in accordance with the principles of the present disclosure.

In accordance with the present disclosure, a hair grooming device 100 is provided that comprises a brush 102 including a handle 104, a casing 106 coupled to the handle 104 for movement with the handle 104, and a plurality of bristles, tines or teeth 108 coupled to a base 110, which base 110 may be flexible and fixedly coupled to the casing 106 for movement with the casing 106, see FIG. 1. The hair grooming device 100 may also comprise a comb (not shown) comprising a plurality of tines or teeth, which may be formed with and extend from a handle or base support. The bristles, tines or teeth 108 may define a structural feature, which is configured to contact the hair of a person when the device 100 is being used by the person or by another user applying the device 100 to the person's hair during a hair grooming event.

The structural feature 112 can include within its perimeter a proximity sensor 114 that is configured to measure, determine, or indicate when the structural feature 112, e.g., the bristles, tines or teeth 108, is proximate to a person's hair that is being engaged or interacted with by the hair grooming device 100. The proximity sensor 114 can, for example, be a light-dependent resistor which provides a resistance value, in ohms, that depends on the amount of light, e.g., ambient light, that is incident on the light-dependent resistor. The proximity sensor 114 may be mounted at or near a center location of the base 110 or extend through the base 110 at or near a center location of the base 110, see FIG. 3. The proximity sensor 114 may extend only a small distance above an outer surface 110A of the base 110 so as to be located well below distal ends 108A of the bristles, tines or teeth 108 so as to not interfere or provide additional resistance to the bristles, tines or teeth 108 moving through the person's hair. As one example, when the structural feature 112, is close to, or in contact with a person's hair, then the light incident on the light-resistant resistor 114 is reduced as compared to when the structural feature 112 is farther away from the person's hair. As is understood in the art, the amount of light incident on a light dependent resistor results in that resistor providing a resistance value indicative of the amount of incident light. Thus, the light dependent resistor 114 performs as a proximity sensor, which provides a value, or data, that is indicative of the proximity of the hair grooming device 100 to a person's hair. More specifically, a current can be sensed that is dependent on the resistance value of the light dependent resistor 114 and that sensed current comprises values or data that is indicative of the proximity of the hair grooming device 100 to a person's hair.

For example, when the hair grooming device 100 is proximate to, or in contact with, a person's hair, then the proximity sensor 114 can sense a relatively high resistance value because there is little or no light incident on the proximity sensor 114. However, as the hair grooming device 100 becomes more distant from the person's hair, then there is more light incident on the proximity sensor 114 which can result in a lower resistance value. Thus the sensed current passing through the light dependent resistor is inversely related to the resistance of the light dependent resistor (i.e., the proximity sensor) 114. As illustrated in FIG. 3, the proximity sensor may be centrally located with respect to the structural feature 112. One of ordinary skill will recognize that different positions or locations of the proximity sensor 114 can be utilized without departing from the scope of the present disclosure. Also, FIGS. 1-3 depict only a single proximity sensor 114 but more than one proximity sensor may beneficially be used to provide data regarding when the hair grooming device 100 is proximate to a person's hair.

In addition to the proximity sensor 114, the hair grooming device 100 can include one or more additional sensors. As an example, the handle 104 can include one or more force, or pressure, sensors that sense a value related to a force or pressure a user applies to the handle 104 while the hair grooming device 100 is engaged with the person's hair. The force or pressure applied to the handle 104 by the user may comprise or be related to a gripping force applied by the user's hand to the handle 104, which gripping force may be equal to or defined by a force or pressure applied by the hand, e.g., the user's thumb, at one or more locations on the handle 104. In the embodiment illustrated in FIGS. 1-3, first and second force-sensitive resistors 120 and 122, also referred to as pressure sensors, are provided on the handle 104 near the casing 106 on opposing sides of the handle 104. A user's thumb may engage and apply a force to the first force-sensitive resistor 120 and one or more other fingers on the user's hand may engage and apply a separate force to the second force-sensitive resistor 122 during a hair grooming event. The signals generated by the first and second force-sensitive resistors 120 and 122 may be considered separately or in combination to determine the force or pressure applied to the handle 104 by the user. Thus, during a hair grooming event, the hair grooming device 100 interacts with the person's hair such as when the hair grooming device 100 is used to brush or comb the person's hair. One or both of the force-sensitive resistors 120 and 122 can indicate an amount of pressure or force a person's hand applies to the handle 104, i.e., when gripping the handle 104, as the user moves the structural feature 112 through a person's hair. It is believed that the user's gripping force is indicative of a person's effort exerted during a grooming event. Hence, the force-sensitive resistors 120 and 122 provide a measure of the effort provided by the user of the hair grooming device 100 to groom a person's hair.

Depending on how difficult, or how much effort is needed, to move the structural feature 112 through a person's hair, the force-sensitive resistors 120 and 122 may sense or record different values during different brushing strokes of a same or a different hair grooming event. When the structural feature 112 of the hair grooming device 100 easily passes through a person's hair, e.g., the hair is untangled, then the force-sensitive resistors 120 and 122 may record a lower value than when the condition of the person's hair, e.g., the hair is tangled, requires a greater effort to pass through the person's hair.

Figure 2:
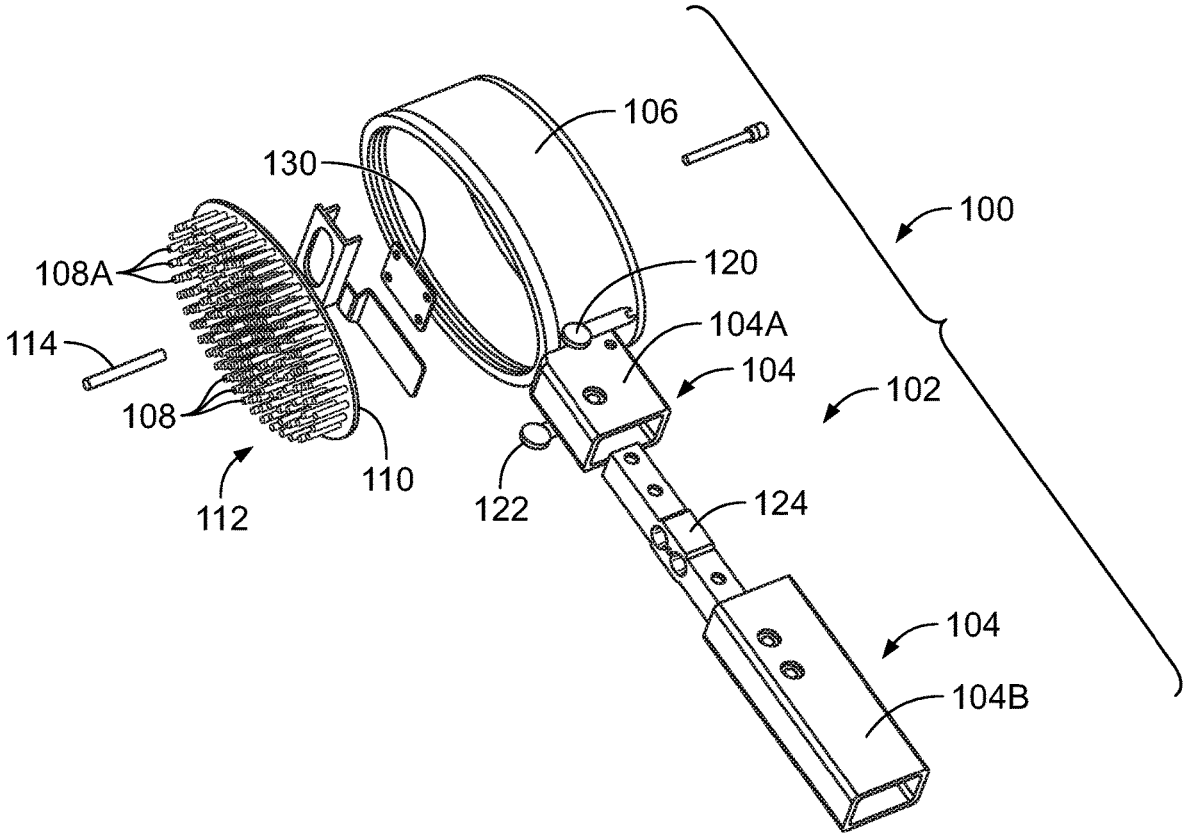
FIG. 2 is an exploded view of the hair grooming device of FIG. 1.
Figure 3:
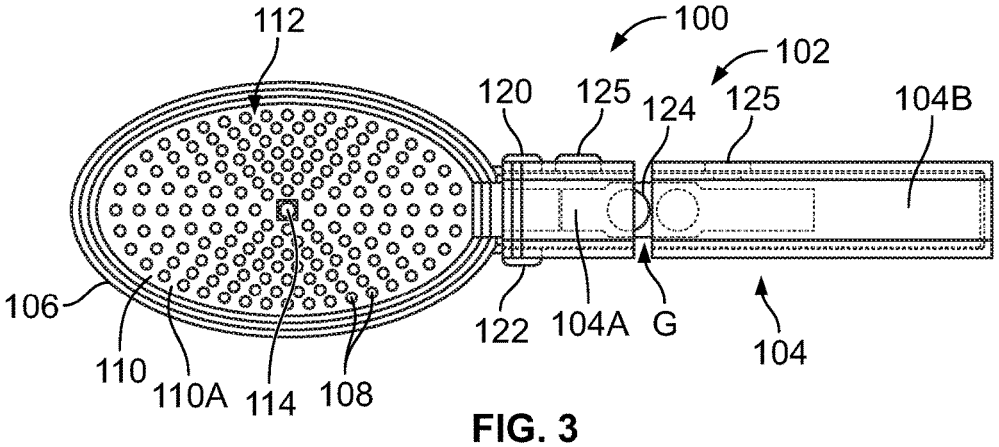
FIG. 3 is a plan view of the hair grooming device of FIG. 1.

In the embodiment illustrated in FIGS. 1-3, the hair grooming device 100 comprises a load cell 124 mounting in the handle 104. The handle 104 comprises first and second separate sections 104A and 104B. The load cell 124 is positioned between and mounted to the first and second handle sections 104A and 104B by screws 125. There may be a slight gap G between the first and second handle sections 104A and 104B to allow the load cell 124 to transmit forces across the handle sections 104A and 104B. The forces applied across the first and second handle sections 104A and 104B during a hair grooming event due to the structural feature 112 engaging the hair will be measured by the load cell. The forces applied across the first and second handle sections 104A and 104B include a force, i.e., a comb/brush force, applied by the structural feature 112 to the person's hair.

In the embodiment illustrated in FIGS. 1-3, the hair grooming device 100 may also comprise a gyroscope-accelerometer 130, which is located within the casing 106 under the base 110, see FIG. 2. The gyroscope-accelerometer 130 may provide signals during a hair grooming event from which the velocity and acceleration of the hair grooming device 100 during grooming may be determined or calculated. From the velocity and/or acceleration values determined for the hair grooming device 100, information regarding the amount/number of tangles in hair through which the structural feature 112 has passed or the combing resistance during one or more brushing strokes may be determined.

As described, the hair grooming device 100 of FIGS. 1-3 comprises a proximity sensor 114, which provides a value that is indicative of the proximity of the hair grooming device 100 to the hair of a person. The hair grooming device 100 may include one or more additional sensors (e.g., sensors 120, 122, 124 and 130) that are integrated with the hair grooming device 100 which measure an interaction of the hair grooming device 100 with the person's hair during a hair grooming event. Accordingly, the data or values from one or more of the sensor(s) 120, 122, 124 and 130 and the data or values from the proximity sensor 114 can be collected concurrently with one another during a hair grooming event.

Figure 4:
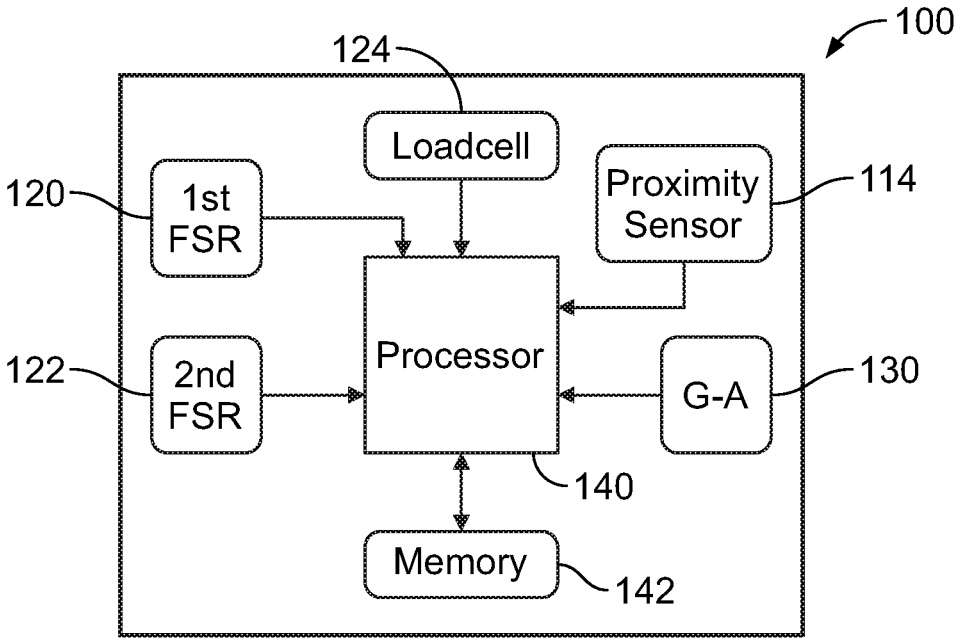
FIG. 4 is a block diagram of a hair grooming device constructed in accordance with a first embodiment of the present disclosure.

The data or values collected from the proximity sensor 114, and one or more of the first and second force-sensitive resistors 120 and 122, the load cell 124 and the gyroscope-accelerometer 130 can be stored on the hair grooming device 100. FIG. 4 shows a block diagram of the hair grooming device 100, which comprises a processor 140 and a memory, a memory circuitry, a processor readable storage medium or a storage device 142 accessible by the processor 140, where the processor 140 and the storage device 142 are physically located on the hair grooming device 100, e.g., the processor 140 and the storage device 142 may be located in the casing 106. The processor 142 can be a microprocessor or microcontroller or similar, equivalent device that is in communication with the sensors 114, 120, 122, 124 and 130 and the memory or storage device 142. The memory or storage device 142 may store data or values that are sensed by the sensors 114, 120, 122, 124 and 130. The memory or storage device 142, in addition to storing sensor data, can also store and provide executable instructions which the processor 140 can access and execute. The processor 140, when executing these instructions, can implement the one or more methods described herein and embody or comprise part of a system(s) that can implement such methods. As an example, in one embodiment, the processor 140 can execute instructions so as to perform the collecting of sensor data or the collecting and filtering of sensor data as described with respect to FIGS. 6-8.

Figure 5:
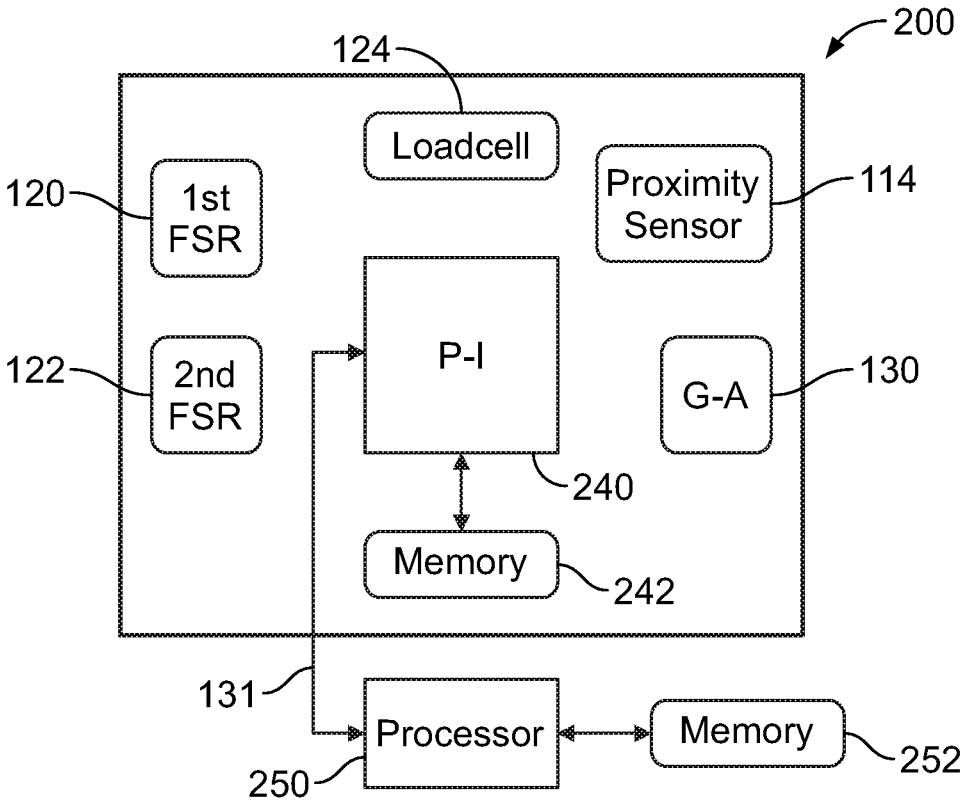
FIG. 5 is a block diagram of a hair grooming device constructed in accordance with a second embodiment of the present disclosure.

FIG. 5 depicts an alternative hair grooming device 200, which comprises the handle 104, casing 106, bristles, tines or teeth 108, base 110, proximity sensor 114, first and second force-sensitive resistors 120 and 122, load cell 124 and gyroscope-accelerometer 130 of the hair grooming device 100 of FIGS. 1-4. In this embodiment, the hair grooming device 200 may include a processor and/or a communication interface 240, e.g., the processor and/or communication interface 240 may be located in the casing 106 of the hair grooming device 200. The processor and/or a communication interface 240 may communicate with the proximity sensor 114, first and second force-sensitive resistors 120 and 122, load cell 124 and gyroscope-accelerometer 130 and store the data and values from the sensors 114, 120, 122, 124 and 130 on a memory, a memory circuitry, a processor readable storage medium or a storage device 242 located on the hair grooming device 200, e.g., the memory, the memory circuitry, the processor readable storage medium or the storage device 242 may be located in the casing 106 of the hair grooming device 200. The processor and/or the communication interface 240 may also provide the stored data and values from the proximity sensor 114 and one or more of the first and second force-sensitive resistors 120 and 122, load cell 124 and gyroscope-accelerometer 130 to an external apparatus comprising a processor 250.

The processor and/or the communication interface 240 may communicate data or values from the proximity sensor 114 and one or more of the first and second force-sensitive resistors 120 and 122, load cell 124 and gyroscope-accelerometer 130 to the external processor 250 using a cable or equivalent medium 131. The communications medium 131 can, for example, be a cable such as Universal Serial Bus (USB) cable or can be wireless such as, for example, WiFi or Bluetooth. The processor 250 may comprise a microprocessor or microcontroller or similar, equivalent device that is in communication with a memory, a memory circuitry, a processor readable storage medium or storage device 252, that receives and stores data received from the processor 250.

In addition to the first and second force-sensitive resistors 120 and 122, load cell 124 and gyroscope-accelerometer 130 on the hair grooming device 100 or 200, a variety of additional sensors can be integrated with the hair grooming device. These additional sensors can include one or more of a temperature sensor and an acoustic sensor, etc.

Figure 6:
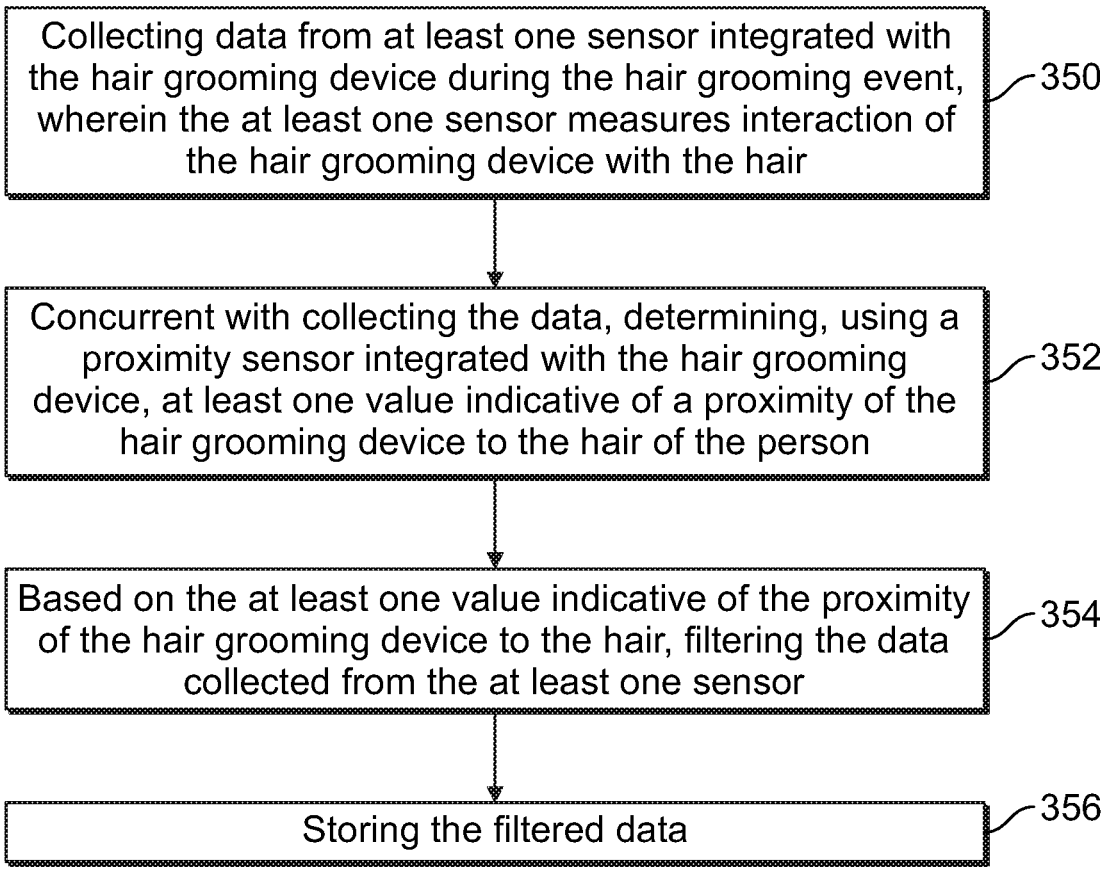
FIG. 6 is a flowchart of an example method of using a hair grooming device in accordance with the principles of the present disclosure.

In practice, the hair grooming device 100 or 200 alone or in combination with the apparatus 250 can be utilized to collect and filter data during a hair grooming event involving a person's hair. The hair grooming device 100 or 200 can be used by the person herself/himself or by another person that is using the hair grooming device 100 or 200 to groom that person's hair. FIG. 6 is a flowchart of an example method of using a hair grooming device in accordance with the principles of the present disclosure. The processor 140, the processor and/or a communication interface 240 or the apparatus 250 can execute instructions written in accordance with the method of FIG. 6 to implement the method of FIG. 6.

In step 350, the method of FIG. 6 includes collecting data from at least one sensor integrated with or forming part of the hair grooming device 100 or 200 during the hair grooming event, wherein the at least one sensor measures interaction of the hair grooming device with the hair. One or more of the first and second force-sensitive resistors 120 and 122, load cell 124 or gyroscope-accelerometer 130 can provide data that is indicative of the interaction of the hair grooming device 100 or 200 with a person's hair during a hair grooming event.

In step 352, concurrent with collecting the data from the one or more of the first and second force-sensitive resistors 120 and 122, load cell 124 or gyroscope-accelerometer 130, the method also includes determining from data collected using a proximity sensor integrated with the hair grooming device, at least one value indicative of a proximity of the hair grooming device to the hair of the person. The sensor value(s) or data from the proximity sensor of the hair grooming device can be evaluated as a binary value such as either a) the hair grooming device is proximate to the person's hair or b) the hair grooming device is not proximate to the person's hair. As an alternative, the data from the proximity sensor can be evaluated as a probabilistic value. In this alternative, the data from the proximity sensor can vary from a minimum value to a maximum value and the actual measured value is indicative of the likelihood that the hair grooming device is proximate to the person's hair.

The phrase "proximate to" is intended to encompass when the hair grooming device is near or in contact with the person's hair. More particularly, the phrase "proximate to" is intended to encompass when the structural feature 112 is near or in contact with the person's hair. For example, where the proximity sensor is a light dependent resistor, the occurrence of little or no incident light on the resistor is an indication that the hair grooming device is proximate to or in contact with the person's hair. When there is almost full incident light on the resistor, then that likely indicates that the hair grooming device is not proximate to or not in contact with the person's hair. Between these two extremes, there can be a value where the hair grooming device is considered to be proximate to or in contact with the person's hair even though there may be some uncertainty. For example, if the absence of incident light on the light dependent resistor is considered to result in a sensed value of current passing through the light dependent resistor of about 0 units of current and the presence of full incident light is considered to result in a sensed value of current passing through the light dependent resistor of 1000 units of current, then some threshold value between the range of 0 and 1000 units of current can be chosen, or empirically determined, to be indicative that the hair grooming device is proximate to or in contact with the person's hair. One of ordinary skill will recognize that the units of current is used by way of an example and other circuitry is contemplated in which units other than that of current can be used. For example, units of resistance or units of voltage can be considered as equivalent to those of units of current and can also be used without departing from the scope of the present invention. Thus, in the discussion below, units of current may be referred to by way of example but units of voltage or resistance that can be sensed or measured can be considered as being a functionally equivalent substitute as well. In an embodiment, that threshold value can be between about 40% to 50% of the range (e.g., from about 400 to about 500 units of current). Thus, when the value or data sensed based on the light dependent resistor is below about 500 units of current, then the hair grooming device is considered to be proximate to or in contact with the person's hair. When the value or data sensed based on the light dependent resistor is above that threshold (e.g., above about 500 units of current), then the hair grooming device is considered to be not proximate to or not in contact with the person's hair. Hence, the sensed data based on the light dependent resistor does not directly measure the distance from the hair grooming device to a person's hair, but provides a value which is indicative of how close or proximate the hair grooming device is to a person's hair or how likely it is that the hair grooming device is close to or near a person's hair.

In step 354, the method comprises filtering the data collected from the at least one sensor based on the at least one value indicative of the proximity of the hair grooming device to the hair. The data or values from the one or more of the first and second force-sensitive resistors 120 and 122, load cell 124 and gyroscope-accelerometer 130 or other sensors can be collected at all times; however, the most pertinent data is when the hair grooming device is actually engaging or interacting with the person's hair. The proximity sensor indicates when the hair grooming device is proximate to the person's hair and, thus, provides an indication when the data and values from the one or more of the first and second force-sensitive resistors 120 and 122, load cell 124 and gyroscope-accelerometer 130 or other sensors are relevant. When the hair grooming device is not proximate to the person's hair, then the data from the one or more of the first and second force-sensitive resistors 120 and 122, load cell 124 and gyroscope-accelerometer 130 or other sensors have little or no relevance about a condition of the person's hair. Accordingly, the data from the one or more of the first and second force-sensitive resistors 120 and 122, load cell 124 and gyroscope-accelerometer 130 or other sensors, are filtered based on the concurrently collected proximity sensor data. When the hair grooming device is proximate to the person's hair, then the data from the one or more of the first and second force-sensitive resistors 120 and 122, load cell 124 and gyroscope-accelerometer 130 or other sensors is determined to be meaningful and stored for later processing, evaluation or review but when the hair grooming device is not proximate to the person's hair then the sensor data from the one or more of the first and second force-sensitive resistors 120 and 122, load cell 124 and gyroscope-accelerometer 130 or other sensors can be ignored or discarded. In this manner filtering of the sensor data can take place dependent on the values or data being sensed by the proximity sensor.

Finally, in step 356, the method can include storing the filtered data for later processing, evaluation or review which implies discarding or ignoring the sensor data collected when the hair grooming device was not proximate to the person's hair.

For the hair grooming device 100 of FIG. 4, all of steps 350, 352, 354 and 356 can be performed by the processor 140 located on the hair grooming device 100.

For the hair grooming device 200 of FIG. 5, data may be collected based on the proximity sensor (e.g., the light-dependent resistor 114) and one or more of the first and second force-sensitive resistors 120 and 122, load cell 124 and gyroscope-accelerometer 130 by the processor and/or the communication interface 240 for storage on the memory, memory circuitry, processor readable storage medium or a storage device 242. The processor and/or the communication interface 240 may provide the data collected from, or based on, the proximity sensor (e.g., the light-dependent resistor) and one or more of the first and second force-sensitive resistors 120 and 122, load cell 124 and gyroscope-accelerometer 130 to the apparatus 250, which may store the data on the memory, memory circuitry, processor readable storage medium or storage device 252. The apparatus 250 may then perform step 354 to filter the data collected from the one or more of the first and second force-sensitive resistors 120 and 122, load cell 124 and gyroscope-accelerometer 130 based on the data collected from the proximity sensor (e.g., the light-dependent resistor) and store the filtered data. It is also contemplated that the processor and/or the communication interface 240 may filter the data collected from the one or more of the first and second force-sensitive resistors 120 and 122, load cell 124 and gyroscope-accelerometer 130 based on the data collected from the proximity sensor (e.g., the light-dependent resistor) and store the filtered data on the memory, memory circuitry, processor readable storage medium or storage device 242. The processor and/or the communication interface 240 may also provide the filtered data to the apparatus 250, which may store the data on the memory, memory circuitry, processor readable storage medium or storage device 252.

Thus, the processor 140, when executing instructions stored in the storage device 142, can implement or embody a filter that is applied to the data collected from the at least one sensor (e.g. sensors 120, 122), wherein the behavior of the filter, or the effect of the implemented filter, is a result of the proximity of the hair grooming device 100 to the person's hair that are collected, based on, or sensed from the proximity sensor 114. As discussed above, a similar filter can also be implemented using an apparatus 250 that is external to the hair grooming device 100.

Figure 7:
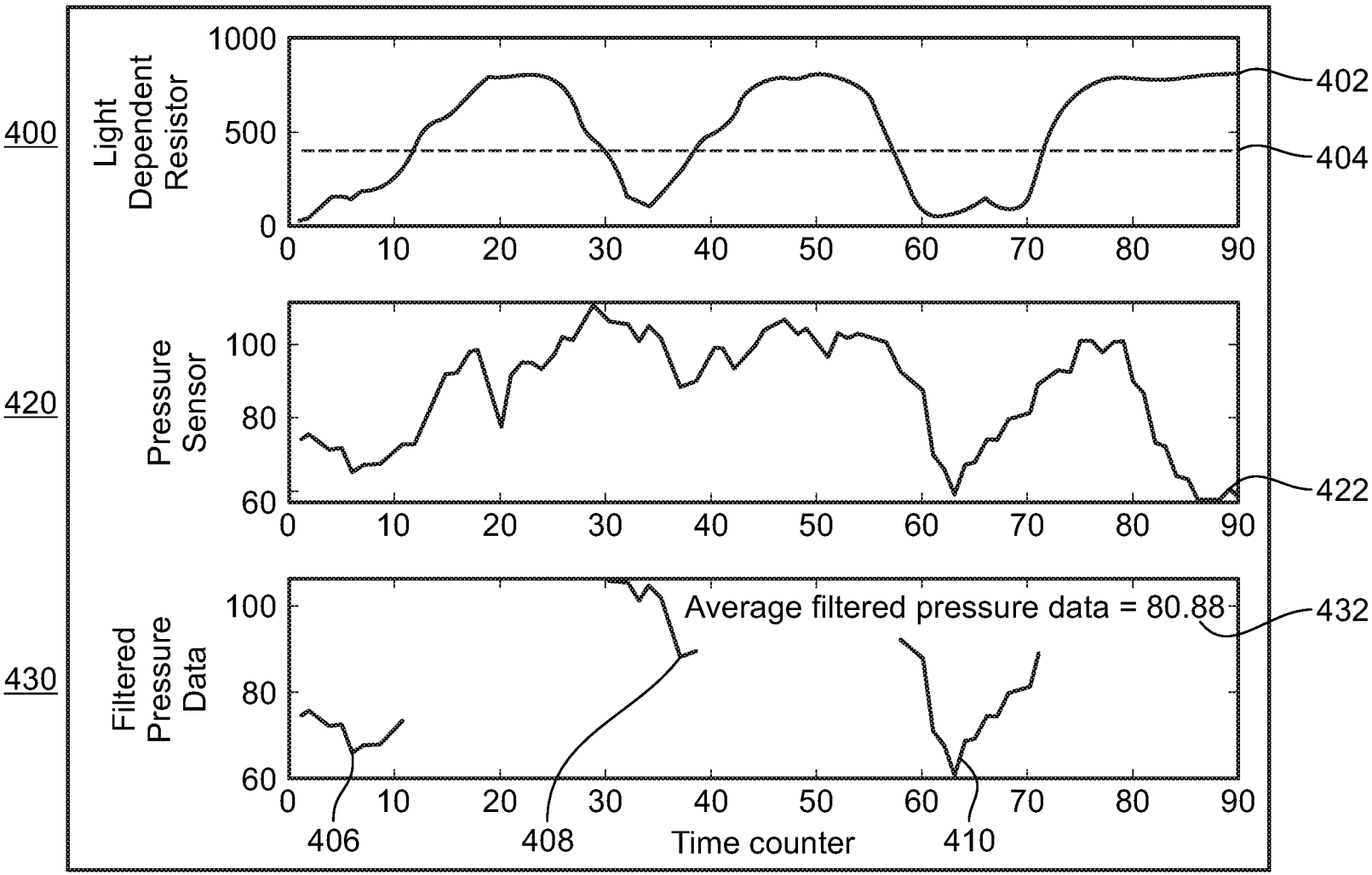
FIG. 7 is a view of a data collected and filtered from a hair grooming device in accordance with the principles of the present disclosure.

FIG. 7 depicts three graphs 400, 420 and 430 that illustrate implementation of the method described with respect to FIG. 6. In the top graph 400, example collected data 402 from a light dependent resistor is shown that was measured and collected for a number of discrete sequentially occurring time intervals or periods within a collection time period (e.g. extending from 0 unit of time to 90 units of time), wherein the collection time period corresponds to a portion or all of a hair grooming event. The light dependent resistor data 402 can result in sensed current data that ranges from 0 units of current to 1000 units of current. The discrete time intervals and collection time period can be measured in seconds or fractions of seconds. During those same discrete sequentially occurring time intervals or time periods, the second graph 420 depicts pressure sensor data or values 422 collected from one of the first or the second force-sensitive resistor 120 or 122. Hence, a respective data value from the light dependent resistor was collected for each of a plurality of sequentially occurring time intervals within a collection time period and a different respective data value from one of the first or the second force-sensitive resistors 120 or 122 was collected for and corresponded to each of the discrete time periods within the collection time period.

In the top graph 400, a threshold value is shown as a dotted line 404. When the value of the current based on the light dependent resistor (e.g., the proximity sensor) was below the threshold 404, then the pressure data 422 was retained and when the value of the current based on the light dependent resistor was above the threshold, then the pressure data 422 was discarded. The result is the bottom graph 430 with only data segments 406, 408 and 410 being retained as a result of the filtering of the pressure sensor data 422. In one embodiment, these filtered data segments 406, 408 and 410 can be averaged to arrive at an average value 432, 80.88 units of pressure in the illustrated example, that is believed to be indicative of the condition of a person's hair during a hair grooming event. The three spaced apart data segments 406, 408 and 410 may correspond to different brushing strokes during a same hair grooming event.

In the bottom graph 430, the values of the data segments 406, 408 and 410 correspond to the same values 402 indicated in the top graph 400 during the corresponding time periods. In other words, to arrive at the bottom graph 430 of the filtered data, the values 402 from the top graph 400 can be considered to be assigned a weight of "1" during the time periods corresponding to segments 406, 408 and 410 but have a weight of "0" assigned during the other time periods (i.e., when the value the current based on the light dependent resistor was above the threshold value 404).

As mentioned above, the value from the proximity sensor can be considered as a probabilistic value indicative of how likely is it that the hair grooming device 100 or 200 is proximate to a person's hair during a hair grooming event. Accordingly, weighting values other than simply "0" and "1" are contemplated. The closer the sensor data values 402 of the top graph 400 are to "0", the more probable or likely it is that the hair grooming device is proximate to the person's hair. Conversely, the closer the sensor data values 402 of the top graph 400 are to "1000", then it is less likely or less probable that the hair grooming device is proximate to the person's hair. It may be beneficial, therefore, to apply a variable weighting value to the sensor data values (e.g., values from one or both of the first and second force-sensitive resistors 120 and 122) that varies depending on the probability that the hair grooming device is proximate to the person's hair. Thus, a weighting value for a sample time period or interval can be determined (e.g., between 0 and 1) depending on the relative value of the light dependent resistor that is sensed during that same time period or interval. The force sensor value, or other sensor value, during that same time period can then multiplied or adjusted by the weighting value. As a result, filtering of sensor values can be accomplished which weights data collected when the hair grooming device is likely proximate to the person's hair greater than data collected when the hair grooming device is likely not proximate to the person's hair.

The present disclosure also contemplates using only a partial range of the possible proximity sensor data values 402 of the top graph 400. For example, proximity sensor values between about 0 and about 500 can be used to determine a variable weighting value as just described. However, proximity sensor values between about 500 and about 1000 can result in assignment of a weighting value of "0" rather than a variable weighting value. As used herein, the term "about" when referring to a value is meant to encompass a variance of 10% or less of its referenced value.

Furthermore, a variable "weighting amount", "weighting value" or "weighting factor" based on the proximity sensor data can be used in conjunction with the data values collected from one or both of the first and second force-sensitive resistors 120 and 122, or any other type of sensors mentioned above. The weighting amount can be used to apply or assign more significance to some data values from a sensor relative to other values collected from that sensor during a hair grooming event.

Referring to FIG. 7, for example, the top graph 400 indicates that individual values are collected for the current passing through the proximity sensor during discrete time intervals or periods numbered 1-90. Concurrently, the middle graph 420 indicates that individual values are collected from a pressure sensor or force-sensitive resistor during those same discrete time intervals or periods 1-90. One or more embodiments in accordance with the present disclosure contemplate a variable weighting factor applied or assigned during each of those discrete time intervals or periods based on a value of the proximity sensor for that respective time interval or period.

For example, when the proximity sensor value 422 during a particular time interval is between "0" and "240" units of current that indicates that the hair grooming device is more likely to be proximate to the person's hair than when the proximity sensor value 422 is between "241" and "480" units of current. Further, when the proximity sensor value 422 is above the threshold value 404 (which in FIG. 7 is about "480" units of current), then the hair grooming device is not likely to be proximate to the person's hair.

Accordingly, a weighting amount of "1", for example, can be applied or assigned for a time interval in which the proximity sensor value is below or equal to "240" units of current. A weighting amount of "0.5" can be applied or assigned for any time interval in which the proximity sensor value is between "241" and "480" units of current. Also, a weighting amount of "0" can be applied or assigned during any time interval in which the proximity sensor value 422 is greater than the threshold value 404. One of ordinary skill will recognize that these values are provided merely by way of example and can be varied without departing from the scope of the present disclosure.

Thus, respective filtered data can be calculated for each discrete time interval by multiplying the assigned weighting amount for that time interval and the sensor data value 422 for that same time interval. The filtered data values having non-zero weighting amounts for the multiple time intervals can then be summed together and divided by the number of filtered data values having non-zero weighting amounts so that an average value can be calculated that is indicative of, or is a measure of, an interaction of the hair grooming device with the hair of the person during a hair grooming event.

Figure 8:
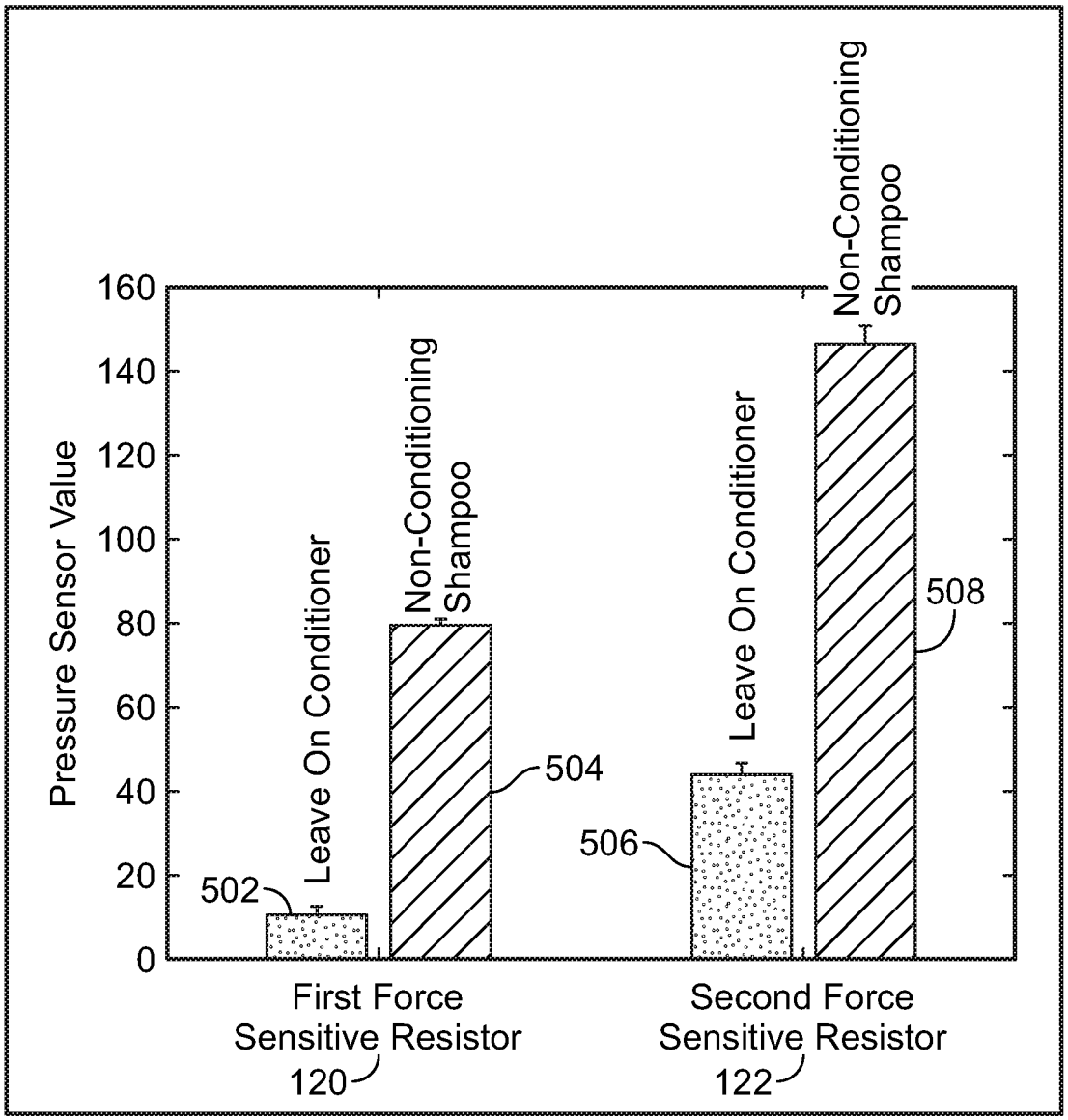
FIG. 8 is a view of a comparison of data collected from a hair grooming device in accordance with the principles of the present disclosure.

FIG. 8 depicts a graph that illustrates data from first and second force-sensitive resistors 120 and 122 collected during separate first and second hair grooming events. The bar charts 502 and 504 relate to data collected from the first force-sensitive resistor 120 during the first and second hair grooming events. The bar charts 506 and 508 relate to data collected from the second force-sensitive resistor 122 during the first and second hair grooming events. The value of each of the bar charts 502, 504, 506, 508 are average sensor data, calculated in accordance with the method of FIG. 6 and also calculated in the same manner as the average value 432 of the filtered data segments 406, 408 and 410 of the example of FIG. 7. Hence, during the first hair grooming event, a graph based on light dependent resistor data was collected over a first collection time period. Concurrently, a first graph of pressure sensor data from the first force-sensitive resistor 120 was collected during the first collection period and a second graph of pressure sensor data from the second force-sensitive resistor 122 was collected during the first collection period. When the value based on the light dependent resistor (e.g., the proximity sensor) was below a predefined threshold, then the pressure data from both the first and second force-sensitive resistors 120 and 122 was retained and when value based on the light dependent resistor was above the threshold, then the pressure data from the resistors 120 and 122 was discarded. The filtered data from the first force-sensitive resistor 120 was averaged for the first hair grooming event, where conditioner was applied to the hair after shampooing, wherein the averaged value was 10 units of pressure, see bar chart 502. Likewise, the filtered data from the second force-sensitive resistor 122 was averaged for the first hair grooming event, where conditioner was applied to the hair after shampooing, which averaged value was 45 units of pressure, see bar chart 506.

During the second hair grooming event, a graph based on light dependent resistor data was collected over a second collection time period. Concurrently, a third graph of pressure sensor data from the first force-sensitive resistor 120 was collected during the second collection period and a fourth graph of pressure sensor data from the second force-sensitive resistor 122 was collected during the second collection period. When the value based on the light dependent resistor (e.g., the proximity sensor) was below a predefined threshold, then the pressure data from both the first and second force-sensitive resistors 120 and 122 was retained and when value from the light dependent resistor was above the threshold, then the pressure data from the resistors 120 and 122 was discarded. The filtered data from the first force-sensitive resistor 120 was averaged for the second hair grooming event, where conditioner was not applied to the hair after shampooing, wherein the averaged value was 80 units of pressure, see bar chart 504. Likewise, the filtered data from the second force-sensitive resistor 122 was averaged for the second hair grooming event, where conditioner was not applied to the hair after shampooing, which averaged value was 145 units of pressure, see bar chart 508.

The y-axis of the graph of FIG. 8, relates to the pressure sensed by the first and second force-sensitive resistors 120 and 122. When more pressure or force was sensed by the resistors 120 and 122 it is believed that more force was being used to grip the hair grooming device 100 and pass the hair grooming device through the person's hair. Thus, the bar graph 502 and bar graph 506 indicate that less pressure was sensed when grooming the person's hair during the first grooming event than the pressure (shown by bar graphs 504 and 508) applied when grooming the person's hair during the second grooming event. This comparison can be indicative of the effect or difference of the use of the conditioner after shampooing versus the non-use of conditioner after shampooing on the characteristics of the person's hair. Hence, using conditioner during the first hair grooming event allowed for easier brushing of the hair, i.e., less gripping pressure was required, as compared to the second hair grooming event when conditioner was not used.

Accordingly, embodiments disclosed herein allow the comparison of data during different hair grooming events. As used herein, a hair grooming event is when a hair grooming device (e.g., a comb, a brush, or the like) is caused to interact with or engage the hair of a person. This event can involve the person performing the hair grooming event or can involve another party performing the hair grooming event on the person. While a comb or a brush has been used by way of example, other hair grooming devices (e.g., scissors, clippers, etc.) when being operated according their intended purpose can be used to perform a hair grooming event. A hair grooming event, such as one involving a comb or brush, can include multiple, separate interactions (e.g., strokes) between the hair grooming device and the person's hair. A hair grooming event could also include just a single interaction between the hair grooming device and the person's hair. The embodiments include collecting first data from at least one sensor integrated with a hair grooming device during a first hair grooming event, wherein the at least one sensor measures interaction of the hair grooming device with the hair. Concurrent with collecting this first data, a determination is made using a proximity sensor integrated with the hair grooming device of a proximity of the hair grooming device to the hair of the person. As explained above, this first data collected from the at least one sensor can then be filtered based on the first value indicative of the proximity and stored. To accomplish the comparison, second data from the at least one sensor integrated with the device can be collected during the second hair grooming event. Concurrent with collecting this second data, a determination is made using the proximity sensor integrated with the hair grooming device of a proximity of the hair grooming device to the hair of the person. This second data collected from the at least one sensor can then be filtered based on the value indicative of the proximity and stored. After storing both the first and second filtered data, a comparison between the filtered first data to the filtered second data can be performed.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for measuring interaction of a hair grooming device with hair of a person during a hair grooming event, the method comprising:

(a) collecting data from at least one sensor integrated with the hair grooming device during the hair grooming event, wherein the at least one sensor measures interaction of the hair grooming device with the hair and collects a respective first data value for each of a series of discrete time periods;

(b) concurrent with collecting the data, determining at least one value indicative of a proximity of the hair grooming device to the hair of the person using a proximity sensor integrated with the hair grooming device, wherein determining the at least one value indicative of a proximity of the hair grooming device to the hair of the person comprises determining a respective second data value corresponding to each of the discrete time periods;

(c) based on the at least one value indicative of the proximity of the hair grooming device to the hair, filtering the data collected from the at least one sensor, wherein filtering the data collected from the at least one sensor comprises:

i) determining a respective weighting value for each of the discrete time periods based on the respective second data value corresponding to each discrete time period, and ii) calculating a respective adjusted data value for each discrete time period based on the respective first data value and the respective weighting value corresponding to each discrete time period, wherein the filtered data comprises the respective adjusted values; and (d) storing the filtered data.

2. The method of claim 1, wherein the hair grooming device comprises a brush, a comb or other device including a structural feature configured to contact the hair of the person when in use.

3. The method of claim 2, wherein the at least one value indicative of the proximity of the hair grooming device to the hair of the person is indicative of the proximity of the structural feature to the hair of the person.

4. The method of claim 1, wherein filtering the data comprises:

determining a weighting amount based on the at least one value indicative of the proximity of the hair grooming device to the hair; and adjusting the collected data based on the weighting amount.

5. The method of claim 1, wherein the proximity sensor comprises a light-dependent resistor.

6. The method of claim 1, wherein the at least one sensor comprises one or more of a pressure sensor, a load cell, an accelerometer, or a gyroscope.

7. The method of claim 1, wherein storing the filtered data comprises storing the filtered data in memory circuitry integrated with the hair grooming device or transmitting the filtered data to an apparatus external to the hair grooming device, the apparatus comprising memory circuitry configured to store the filtered data.

8. The method of claim 1, comprising:

transmitting the collected data to an apparatus external to the hair grooming device;

transmitting, to the apparatus, the at least one value indicative of the proximity of the hair grooming device to the hair of the person; and wherein the filtering of the data collected from the at least one sensor comprises filtering, by the apparatus, the transmitted collected data based on the transmitted at least one value indicative of the proximity of the hair grooming device to the hair of the person.

9. The method of claim 1, wherein filtering the collected data comprises discarding the collected data when the at least one value indicative of the proximity of the hair grooming device to the hair of the person indicates that the hair grooming device is not proximate to the hair of the person.

10. The method of claim 1, wherein the step of collecting data includes collecting first data from the at least one sensor integrated with the device during a first hair grooming event;

the step of determining at least one value indicative of a proximity of the hair grooming device to the hair of the person using a proximity sensor integrated with the hair grooming device determines at least one first value indicative of a proximity of the device to the hair of the person;

and based on the at least one first value indicative of the proximity, the first data collected from the at least one sensor is filtered; and the method further comprises:

collecting second data from the at least one sensor integrated with the device during a second hair grooming event;

concurrent with collecting the second data, determining at least one second value indicative of the proximity of the device to the hair of the person using the proximity sensor integrated with the device;

based on the at least one second value indicative of the proximity, filtering the second data collected from the at least one sensor; and comparing the filtered first data to the filtered second data.

11. A system for measuring interaction of a hair grooming device with hair of a person during a hair grooming event, the system comprising:

the hair grooming device;

a sensor integrated with the hair grooming device, wherein the sensor measures interaction of the hair grooming device with the hair;

a processor in communication with a processor readable storage medium with executable instructions stored thereon, wherein the processor, when executing the executable instructions:

(a) collects data from the at least one sensor by collecting a respective first data value for each of a series of discrete time periods, and (b) concurrent with collecting the data, determines, using a proximity sensor integrated with the hair grooming device, at least one value indicative of a proximity of the hair grooming device to the hair of the person, wherein determining the at least one value indicative of a proximity of the hair grooming device to the hair of the person comprises determining a respective second data value corresponding to each of the discrete time periods;

a filter applied to the data collected from the at least one sensor, wherein the filter is based on the at least one value indicative of the proximity of the hair grooming device to the hair, and wherein applying the filter to the data collected from the at least one sensor comprises:

(a) determining a respective weighting value for each of the discrete time periods based on the respective second data value corresponding to each discrete time period; and (b) calculating a respective adjusted data value for each discrete time period based on the respective first data value and the respective weighting value corresponding to each discrete time period, wherein the filtered data comprises the respective adjusted values; and a storage device in communication with the filter and configured to store the filtered data.

12. The system of claim 11, wherein the hair grooming device comprises a brush, comb or other device including a structural feature configured to contact the hair of the person when in use.

13. The system of claim 11, wherein applying the filter to the data collected from the at least one sensor comprises:

determining a weighting amount based on the at least one value indicative of the proximity of the hair grooming device to the hair; and adjusting the collected data based on the weighting amount.

14. The system of claim 11, wherein the proximity sensor comprises a light-dependent resistor.

15. The system of claim 11, wherein the at least one sensor comprises one or more of a pressure sensor, a load cell, an accelerometer, or a gyroscope.

16. The system of claim 11, wherein the processor when executing the executable instructions transmits the filtered data to an apparatus external to the hair grooming device, the apparatus comprising memory circuitry defining the storage device configured to store the filtered data.

17. The system of claim 11, wherein the processor when executing the executable instructions:

transmits the collected data to an apparatus external to the hair grooming device;

transmits, to the apparatus, the at least one value indicative of the proximity of the hair grooming device to the hair of the person; and wherein the filtering of the data collected from the at least one sensor comprises filtering, by the apparatus, the transmitted collected data based on the transmitted at least one value indicative of the proximity of the hair grooming device to the hair of the person.

18. The system of claim 11, wherein applying a filter to the collected data comprises discarding the collected data when the at least one value indicative of the proximity of the hair grooming device to the hair of the person indicates that the hair grooming device is not proximate to the hair of the person.

19. The system of claim 11 wherein the processor when executing the executable instructions:

collects first data from at least one sensor integrated with the device during a first hair grooming event;

concurrent with collecting the first data, determines, using a proximity sensor integrated with the device, at least one first value indicative of a proximity of the device to the hair of the person;

filters the first data collected from the at least one sensor based on the at least one first value indicative of the proximity;

stores the filtered first data;

collects second data from the at least one sensor integrated with the device during a second hair grooming event;

concurrent with collecting the second data, determines, using the proximity sensor integrated with the device, at least one second value indicative of the proximity of the device to the hair of the person;

filters the second data collected from the at least one sensor based on the at least one second value indicative of the proximity; and compares the filtered first data to the filtered second data.

* * * * *